US005524441A

United States Patent [19]

Herrmann et al.

[11] Patent Number: 5,524,441

[45] Date of Patent: Jun. 11, 1996

[54] LEAD-IN MODULE FOR THE SUPPLY OF A LOW CRITICAL TEMPERATURE SUPERCONDUCTING ELECTRIC LOAD

[75] Inventors: Peter F. Herrmann, Dourdan Corbreuse; Erick Beghin, Massy; Christian Cottevieille, Montreuil, all of France

[73] Assignee: GEC Alsthom Electromecanique SA, Paris, France

[21] Appl. No.: 352,749

[22] Filed: Dec. 2, 1994

[30] Foreign Application Priority Data

Dec. 3, 1993 [FR] France ..... 9314541

[51] Int. Cl.[6] ..... F25B 19/00

[52] U.S. Cl. ..... 62/51.1; 62/259.2; 505/892

[58] Field of Search ..... 62/51.1, 259.2; 505/892

[56] References Cited

U.S. PATENT DOCUMENTS

| | | | |
|---|---|---|---|
| 4,796,432 | 1/1989 | Fixsen et al. | 62/51.1 |
| 4,805,420 | 2/1989 | Porter et al. | 62/51.1 |
| 5,166,776 | 11/1992 | Dederer et al. | 62/51.1 |

FOREIGN PATENT DOCUMENTS

| | | |
|---|---|---|
| 0122498A2 | 10/1984 | European Pat. Off. . |
| 5108434 | 8/1993 | Japan . |

OTHER PUBLICATIONS

*Patent Abstracts of Japan*, vol. 13, No. 110 (E–728) 16 Mar. 1989 & JP–A–63 283 083 (Hitachi Ltd). 28 Nov. 1988.

*Patent Abstracts of Japan*, vol. 14, No. 102 (E–0894) 23 Feb. 1990 & JP–A–01 304 670 (Mitsubishi Electric Corp.).

*Primary Examiner*—Ronald C. Capossela

*Attorney, Agent, or Firm*—Sughrue, Mion, Zinn, Macpeak & Seas

[57] ABSTRACT

Lead-in module for the supply of a low critical temperature superconducting electric load The module (3) is located inside a cryostat (1), it is fixed to its sealing cover (2) and it comprises a pair of metal conductors (6, 7) which pass through the cover (2) and whose lower ends are connected to the upper end of a high critical temperature superconducting module (8) comprising two conductors (9, 10) electrically connected to said pair of metal conductors (6, 7) and separated by an insulating core (11) making up a mechanical reinforcement, with an insulating structure (14) whose upper end (15) is fixed to the bottom of said cover (2) of the cryostat (1), surrounding the pair of metal conductors (6, 7) in a sealed manner until its junction (16) with the superconducting module (8), the structure (14) extending in an unsealed manner until at least the lower end of the superconducting module (8), the structure (14) comprising at its lower end fastening means (20) to support the electric load (4).

8 Claims, 1 Drawing Sheet

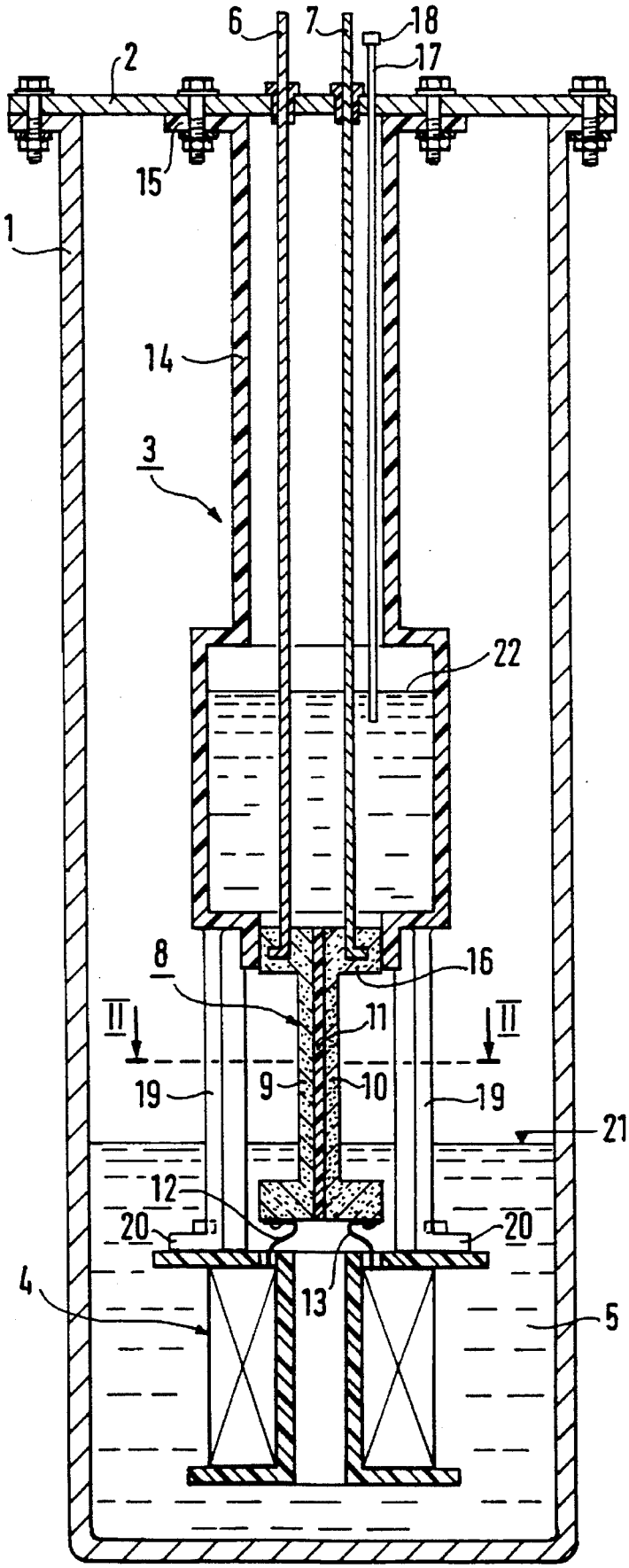
FIG.1
FIG.2
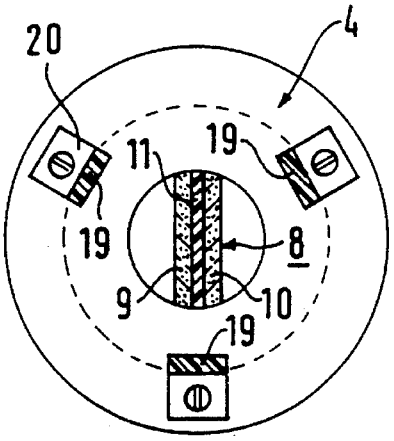

LEAD-IN MODULE FOR THE SUPPLY OF A LOW CRITICAL TEMPERATURE SUPERCONDUCTING ELECTRIC LOAD

BACKGROUND OF THE INVENTION

1. Field of the Invention

The present invention concerns a lead-in module for the supply of a low critical temperature superconducting electric load.

The invention particularly applies to currents ranging from a few ten's to a few hundred amperes.

2. Description of the Related Art

Lead-in modules are known of which consist of metal conductors, made of copper, for example, connected to the electric load located within liquid helium, with the connection between the load and the lead-in conductors submerged in the helium. However, this type of arrangement results in losses through the Joule effect in the lead-in conductors and also through thermal conduction, leading to a significant helium consumption. It is also necessary to provide a support for the load, which can also result in losses through conduction.

SUMMARY OF THE INVENTION

The purpose of this invention is to eliminate these disadvantages and its object is a lead-in module for the electrical supply of a low critical temperature superconducting electric load, said module being located inside a cryostat and fixed to its sealing cover, characterized in that it comprises a pair of metal conductors which pass through said cover and whose lower ends are connected to the upper end of a high critical temperature superconducting module comprising two conductors electrically connected to said pair of metal conductors and separated by an insulating core making up a mechanical reinforcement, with an insulating structure whose upper end is fixed to the bottom of said cover of the cryostat, surrounding said pair of metal conductors in a sealed manner until its junction with said high critical temperature superconducting module, said structure extending in an unsealed manner until at least the lower end of said superconducting module, said structure comprising at its lower end fastening means to support said electric load.

According to another characteristic, the sealed part of said insulating structure is partly filled with liquid nitrogen.

According to another characteristic, said electric load is electrically connected to the lower end of the two conductors of the high critical temperature superconducting module, and said cryostat is partly filled with liquid helium to a level reaching at least said electrical connection between said load and said conductors of the superconducting module.

Advantageously, both said structure and the insulating core separating the two conductors of the superconducting module are made of loaded epoxy resin, with the two conductors made of superconducting ceramic.

BRIEF DESCRIPTION OF THE DRAWINGS

A description will now be provided of an example of the invention's implementation referring to the attached drawing in which:

FIG. 1 is a diagram of a lead-in module according to the invention located inside the cryostat.

FIG. 2 is a cross-section along II—II of FIG. 1.

DETAILED DESCRIPTION OF THE PREFERRED EMBODIMENTS

Referring to the figures, a cryostat 1 is shown with its sealing cover 2 to which is fixed a lead-in module 3 according to the invention for the electrical supply of a low critical temperature superconducting electric load 4, such as a coil. This electric load 4 is submerged in liquid helium 5 at 4.2° K.

The lead-in module 3 comprises a pair of metal conductors 6 and 7, made of copper for example, connected at their lower ends to the upper end of a high critical temperature superconducting module 8 comprising two conductors 9 and 10 made of superconducting ceramic with a critical temperature $Tc \geqq 80°$ K and separated by an insulating core 11 made of loaded epoxy resin which makes up a mechanical reinforcement for conductors 9, 10.

The superconducting ceramic conductors 9, 10 are electrically connected to copper conductors 6, 7 by means of a process known per se.

At their lower ends, superconducting ceramic conductors 9, 10 are also electrically connected to the two ends 12, 13 of loading coil 4 in a manner known per se. This, for example, can consist of a solder which can be easily undone in order to possibly change the load 4.

The metal conductors 6, 7 are surrounded by an insulating structure 14 made of loaded epoxy resin, for example, which is fixed to the bottom of the cryostat's cover 2 by means of a flange 15.

This structure 14 makes up a sealed enclosure until the junction 16 between the metal conductors 6, 7 and the conductors 9, 10 of the superconducting module 8. This junction 16 makes up the bottom of this sealed enclosure. The lower part of this sealed enclosure contains liquid nitrogen 22 at 77° K.

A tube 17 which passes through the cover 2 ensures the supply of nitrogen. This tube is equipped with a plug 18.

Below the junction 16, the structure 14 made of loaded epoxy resin extends until beneath the lower end of the superconducting module 8 by means of a plurality of struts 19 whose lower ends form a flange 20 to fasten the load 4 which is thus suspended on to the structure 14.

The helium level 21 in the cryostat is such that it lies above the electrical connection between the conductors 12, 13 of the load 4 and the ceramic superconducting conductors 9, 10.

A lead-in is thus obtained which creates only a weak cryogenic load at the temperature of the liquid helium. Indeed, the copper conductors 6, 7 are not submerged in the helium.

The nitrogen 22 keeps the upper end of the superconducting module 8, i.e. the junction 16, at a temperature of 77° K, a temperature below the critical temperature.

The intermediate temperature of the junction 16 can also be obtained by placing a heat exchanger within the insulating structure 14 in its sealed part. This exchanger is in contact with the junction 16 and a stream of cold gas flows through it.

The structure 14 made of loaded epoxy resin, molded as a single piece, is sturdy and ensures both the role of a nitrogen tank 22, making it possible to obtain, from the lower end of the module 8 at 4.2° K until the junction 16 at 77° K, a temperature gradient which, as mentioned above, keeps the module 8 at a temperature below its critical temperature throughout its entire length as long as the working current is not seriously exceeded and, at the same time, this structure 14 ensures the role of a mechanical support for the electric load 4.

We claim:

1. A lead-in module for the electrical supply of a low critical temperature superconducting electric load, said module adapted for being disposed inside a cryostat and fixed to its sealing cover, said module comprising:

a pair of metal conductors which passes through said cover and whose lower ends are connected to the upper end of a high critical temperature superconducting module comprising two conductors which are electrically connected to said pair of metal conductors and separated by an insulating core (11) which mechanically reinforces said pair of metal conductors;

an insulating structure having an upper end which is adapted for being fixed to the bottom of said cover of the cryostat, said insulating structure surrounding said pair of metal conductors to isolate said metal conductors from outside of said insulating structure along the lengths of said metal conductors to a junction at which said metal conductors are connected to said high critical temperature superconducting module, a portion of said insulating structure extending to at least the lower end of said superconducting module without isolating said superconducting module from said outside, said structure having a lower end including a fastening device which mechanically supports said electric load.

2. A module according to claim 1, wherein said structure is made of loaded epoxy resin.

3. A module according to claim 1, wherein said insulating core is made of loaded epoxy resin.

4. A module according to claim 1, wherein the sealed part of said insulating structure is partly filled with liquid nitrogen.

5. A module according to claim 1, wherein the sealed part of said insulating structure is equipped with a heat exchanger which is in contact with said junction and has a stream of cold gas flowing through it.

6. A module according to claim 1, wherein said electric load is electrically connected to the lower end of the two conductors of said high critical temperature superconducting module, said cryostat is partly filled with liquid helium to a level reaching at least said electrical connection between said electric load and said conductors of said superconducting module.

7. A module according to claim 1, wherein the two said conductors of the said superconducting module are made of superconducting ceramic.

8. A module according to claim 1, wherein said unsealed extension of said structure is made up of a plurality of struts, the entire said structure being molded as a single piece.

* * * * *